US005511450A

United States Patent [19]

Nagao

[11] Patent Number: 5,511,450

[45] Date of Patent: Apr. 30, 1996

[54] METHOD OF MANUFACTURING FORMING DIE

[75] Inventor: Yuichi Nagao, Sayama, Japan

[73] Assignee: Honda Giken Kogyo Kabushiki Kaisha, Tokyo, Japan

[21] Appl. No.: 363,818

[22] Filed: Dec. 27, 1994

[30] Foreign Application Priority Data

Dec. 27, 1993 [JP] Japan ..... 5-333406

[51] Int. Cl.[6] ..... B21C 3/02

[52] U.S. Cl. ..... 76/107.1; 72/467; 76/107.4

[58] Field of Search ..... 76/107.1, 107.4, 76/101.1; 72/467, 462

[56] References Cited

U.S. PATENT DOCUMENTS

| | | | |
|---|---|---|---|
| 4,377,943 | 3/1983 | Fuchs | 72/467 |
| 5,019,114 | 5/1991 | Gronbaek | 76/107.1 X |
| 5,165,309 | 11/1992 | Porucznik et al. | 76/107.4 |
| 5,390,526 | 11/1995 | Balazs et al. | 72/467 |

FOREIGN PATENT DOCUMENTS 2-151338 6/1990 Japan .

*Primary Examiner*—Douglas D. Watts

*Attorney, Agent, or Firm*—Birch, Stewart, Kolasch & Birch

[57] ABSTRACT

A forming die is composed of a die member and a reinforcing member for applying compressive forces radially inwardly to the die member. To manufacture the forming die, tensile stresses applied to elements divided from the die member are simulated, and a fracture region of the die member is specified based on the simulated tensile stresses. An inner circumferential configuration of the reinforcing ring, or an outer circumferential configuration of the die member is determined for cooperation with the die member or the reinforcing ring in producing compressive stresses in the die member to counteract tensile stresses in the fracture region. The reinforcing ring with the inner circumferential configuration or the die member with the outer circumferential configuration is formed, and either the reinforcing ring with the inner circumferential configuration is over the die member, or the reinforcing ring is fitted over the die member with the outer circumferential configuration.

6 Claims, 7 Drawing Sheets

FIG.6

| COUNT | CONTROL FACTOR | | | | | | | | STRESSES | | S/N |
|---|---|---|---|---|---|---|---|---|---|---|---|
| | $I_5$ | $I_1$ | $I_2$ | $I_3$ | $I_4$ | Of | $C_2$ | $C_1$ | $N_1$ | $N_2$ | (dB) |
| 1 | "1" | "1" | "1" | "1" | "1" | "1" | "1" | "1" | 1851 | $\beta_1$ | -50.31 |
| 2 | "1" | "1" | "2" | "2" | "2" | "2" | "2" | "2" | $\alpha_1$ | $\beta_2$ | $\gamma_1$ |
| 3 | "1" | "1" | "3" | "3" | "3" | "3" | "3" | "3" | $\alpha_2$ | 1721 | $\gamma_2$ |
| 4 | "1" | "2" | "1" | "1" | "2" | "2" | "3" | "3" | 1925 | $\beta_3$ | -49.56 |
| 5 | "1" | "2" | "2" | "2" | "3" | "3" | "1" | "1" | $\alpha_3$ | $\beta_4$ | $\gamma_3$ |
| 6 | "1" | "2" | "3" | "3" | "1" | "1" | "2" | "2" | $\alpha_4$ | $\beta_5$ | $\gamma_4$ |
| 7 | "1" | "3" | "1" | "2" | "1" | "3" | "2" | "3" | $\alpha_5$ | 2015 | $\gamma_5$ |
| 8 | "1" | "3" | "2" | "3" | "2" | "1" | "3" | "1" | 1629 | $\beta_6$ | -46.32 |
| 9 | "1" | "3" | "3" | "1" | "3" | "2" | "1" | "2" | $\alpha_6$ | $\beta_7$ | $\gamma_6$ |
| 10 | "2" | "1" | "1" | "3" | "3" | "2" | "2" | "1" | $\alpha_7$ | $\beta_8$ | $\gamma_7$ |
| 11 | "2" | "1" | "2" | "1" | "1" | "3" | "3" | "2" | $\alpha_8$ | 1915 | $\gamma_8$ |
| 12 | "2" | "1" | "3" | "2" | "2" | "1" | "1" | "3" | 1721 | $\beta_9$ | -45.11 |
| 13 | "2" | "2" | "1" | "2" | "3" | "1" | "3" | "2" | $\alpha_9$ | $\beta_{10}$ | $\gamma_9$ |
| 14 | "2" | "2" | "2" | "3" | "1" | "2" | "1" | "3" | $\alpha_{10}$ | 1989 | $\gamma_{10}$ |
| 15 | "2" | "2" | "3" | "1" | "2" | "3" | "2" | "1" | $\alpha_{11}$ | $\beta_{11}$ | $\gamma_{11}$ |
| 16 | "2" | "3" | "1" | "3" | "2" | "3" | "1" | "2" | 2228 | $\beta_{12}$ | -42.72 |
| 17 | "2" | "3" | "2" | "1" | "3" | "1" | "2" | "3" | $\alpha_{12}$ | $\beta_{13}$ | $\gamma_{12}$ |
| 18 | "2" | "3" | "3" | "2" | "1" | "2" | "3" | "1" | $\alpha_{13}$ | 2021 | $\gamma_{13}$ |

METHOD OF MANUFACTURING FORMING DIE

BACKGROUND OF THE INVENTION

1. Field of the Invention

The present invention relates to a method of manufacturing a forming die such as a cold forging die, and more particularly, to a method of manufacturing a forming die that is prevented from cracking under plastic strains and tensile stresses which are applied when a material to be formed is forced into the die.

2. Description of the Related Art

It has been known that a forming die such as a cold forging die tends to develop cracks when a material to be formed is forced into the forming die. According to one theory, plastic strains produced in the forming die by the forced material are considered to be responsible for those cracks developed in the forming die. Another theory indicates that tensile stresses produced in the forming die by the forced material cause the cracks.

Since no established ideas are available for determining the cause of cracks in forming dies, some empirical trial-and-error approaches have been relied upon to prevent forming dies from cracking in use. Specifically, it has been customary to calculate tensile stresses applied to forming dies, design a forming die so that such tensile stresses will not reach fracture stresses, and, if cracks are developed in the designed forming die when it is used to actually form a material, redesign a forming die based on the experience in the design efforts.

However, the conventional procedure dictates a large expenditure of time and cost for changing designs and modifying forming dies, and is unable to fabricate uniform forming dies due to quality control instability.

Japanese laid-open patent publication No. 2-151338 discloses a forming die reinforced with a first ring held against the forming die under radial pressing forces and a second ring held against the first ring under radial pressing forces. While the second ring is being prestressed, the first ring is fitted into the second ring, thereby forming a ring assembly, and then the forming die is fitted into the ring assembly, so that the forming die is contracted in the ring assembly.

The above publication shows the application of compressive stresses radially inwardly to the forming die, but fails to clearly indicate an amount of interference between the forming die and the ring assembly and a position where such an amount of interference is to be introduced. Actually, therefore, a forming die needs to be designed according to trial-and-error attempts.

SUMMARY OF THE INVENTION

It is therefore an object of the present invention to provide a method of manufacturing a forming die by specifically and optimally establishing an interference with a reinforcing ring for increasing the service life of the forming die.

According to an aspect of the present invention, there is provided a method of manufacturing a forming die composed of a die member and a reinforcing member for applying compressive forces radially inwardly to the die member, comprising the steps of (a) simulating tensile stresses applied to elements divided from the die member, (b) specifying a fracture region of the die member based on the simulated tensile stresses, (c) determining an inner circumferential configuration of the reinforcing ring to cooperate with the die member in producing compressive stresses in the die member to counteract tensile stresses in the fracture region, (d) forming the reinforcing ring with the inner circumferential configuration, and (e) fitting the reinforcing ring with the inner circumferential configuration over the die member. The step (c) may comprise the steps of generating an orthogonal square or table of factors including values which represent interferences at a plurality of different heights from a first reference at a bottom of an unformed reinforcing ring, as lengths from a second reference at a cylindrical inner circumferential surface of the unformed reinforcing ring, and information values based on variations of conditions in which a workpiece is fitted in a cavity in the die member, determining optimum values of the lengths based on the orthogonal square to generate an interference distribution curve, and determining the inner circumferential configuration of the reinforcing ring based on the interference distribution curve.

According to an aspect of the present invention, there is also provided a method of manufacturing a forming die composed of a die member and a reinforcing member for applying compressive forces radially inwardly to the die member, comprising the steps of (a) simulating tensile stresses applied to elements divided from the die member, (b) specifying a fracture region of the die member based on the simulated tensile stresses, (c) determining an outer circumferential configuration of the die member to cooperate with the reinforcing ring in producing compressive stresses in the die member to counteract tensile stresses in the fracture region, (d) forming the die member with the outer circumferential configuration, and (e) fitting the reinforcing ring over the die member with the outer circumferential configuration. The step (c) may comprise the steps of generating an orthogonal square of factors including values which represent interferences at a plurality of different heights from a first reference at a bottom of an unformed die member, as lengths from a second reference at a cylindrical outer circumferential surface of the unformed die member, and information values based on variations of conditions in which a workpiece is fitted in a cavity in the die member, determining optimum values of the lengths based on the orthogonal square to generate an interference distribution curve, and determining the inner circumferential configuration of the reinforcing ring based on the interference distribution curve.

The variations may include at least a distance by which a punch is pressed into the cavity, a hardness of the die member, and a shape of an object formed by the formed die.

In the step (a), tensile stresses applied to elements divided from the die member are simulated. Then, in the step (b), a fracture region of the die member is specified based on the simulated tensile stresses. In the step (c), an inner circumferential configuration of the reinforcing ring or an outer circumferential configuration of the die member is determined for cooperation with the die member or the reinforcing ring in producing compressive stresses in the die member to counteract tensile stresses in the fracture region. In the step (d), the reinforcing ring with the inner circumferential configuration or the die member with the outer circumferential configuration is formed. In the step (e), either the reinforcing ring with the inner circumferential configuration is over the die member, or the reinforcing ring is fitted over the die member with the outer circumferential configuration, thereby producing the forming die.

When a workpiece is processed by the forming die thus manufactured, since compressive forces are applied from the reinforcing ring to the die member to develop compressive stresses in the fracture region to counteract tensile stresses which would otherwise tend to develop cracks in the die member, the die member is prevented from cracking. Even if the die member is used an increased number of times, no cracks will be caused in the die member, and the die member will have a prolonged service life. When a workpiece is processed by the forming die, minute crevices or gaps are produced in the die member by plastic strains. However, since tensile stresses are canceled out by the compressive forces imposed by the reinforcing ring, the minute crevices are not enlarged, and hence no cracks are developed in the die member.

In the step (c), an orthogonal square or table is generated which is composed of factors including values which represent interferences at a plurality of different heights from a first reference at a bottom of an unformed reinforcing ring or die member, as lengths from a second reference at a cylindrical outer circumferential surface of the unformed reinforcing ring or die member, and information values based on variations of conditions in which a workpiece is fitted in a cavity in the die member. Then, optimum values of the lengths are determined based on the orthogonal table to generate an interference distribution curve, and the inner circumferential configuration of the reinforcing ring or the outer circumferential configuration of the die member is determined based on the interference distribution curve. Because optimum compressive forces based on the inner circumferential configuration of the reinforcing ring or the outer circumferential configuration of the die member are applied to the specified fracture region in the die member, the die member is prevented from cracking. The forming die can be designed easily through the theoretical process, but not on trial-and-error efforts.

The variations of the conditions in which the workpiece is fitted in the cavity in the die member may include at least a distance by which a punch is pressed into the cavity, a hardness of the die member, and a shape of an object formed by the forming die. As these variations correspond to elements that cannot be controlled by human intervention in the manufacturing process, even if the distance by which the punch is pressed, the hardness of the die member, and the shape of the formed object are varied, the stresses in the die member are stable and lowest.

As described above, either the inner circumferential configuration of the reinforcing ring or the outer circumferential configuration of the die member can be shaped based on the interference distribution curve.

The above and other objects, features, and advantages of the present invention will become apparent from the following description when taken in conjunction with the accompanying drawings which illustrate a preferred embodiment of the present invention by way of example. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 6 is a diagram illustrative of a process of determining an optimum interference distribution curve used in the method according to the present invention;

DETAILED DESCRIPTION OF THE PREFERRED EMBODIMENT

A process of cold-forging a constant-velocity joint with a forming die, and how a crack is developed in the forming die during the process will first be described below.

Figure 1B:
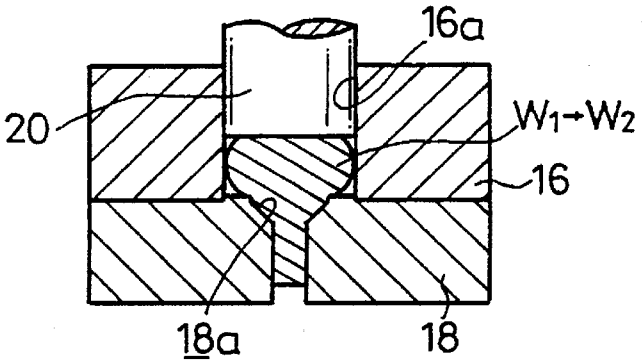
FIG. 1B is a cross-sectional view showing a second step of shaping the workpiece $W_1$ into a workpiece $W_2$ with the forming die in the cold-forging process.
Figure 1D:
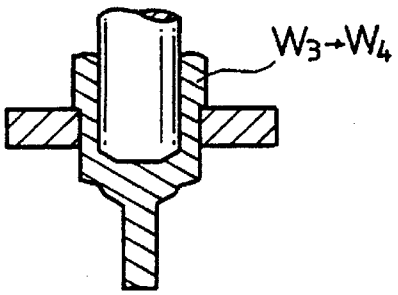
FIG. 1D is a cross-sectional view showing a fourth step of shaping the workpiece $W_3$ into a workpiece $W_4$ with the forming die in the cold-forging process.
Figure 1A:
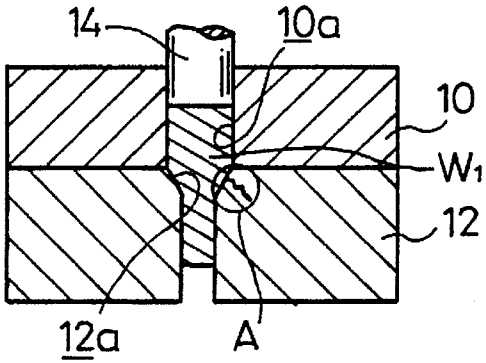
FIG. 1A is a cross-sectional view showing a first step of forming a workpiece $W_1$ with a forming die in a process of cold-forging a constant-velocity joint.

As shown in FIG. 1A, a process of cold-forging a constant-velocity joint first uses a first upper die 10 and a first lower die 12, the first upper die 10 being stacked on the first lower die 12. The first upper die 10 has a larger-diameter through hole 10*a*, and the first lower die 12 has a smaller-diameter through hole 12*a* having an upper end which is spread upwardly. The hole 12*a* is held in communication with the hole 10*a*.

A workpiece $W_1$ in the form of a cylindrical steel rod is inserted in the hole 10*a*, and pressed downwardly toward the first lower die 12 by a first punch 14 having the same diameter as the hole 10*a*. As a result, the workpiece $W_1$ is forced partly into the hole 12*a*, and is given a tapered shape. The workpiece $W_1$ has now been shaped in a forward extrusion step. The shaped workpiece $W_1$ will then be processed in a next step.

As shown in FIG. 1B, the cold-forging process then uses a second upper die 16 and a second lower die 18, the second upper die 16 being stacked on the second lower die 18. The second upper die 16 has a larger-diameter through hole 16*a*, and the second lower die 18 has a smaller-diameter through hole 18*a* having an upper end which is spread upwardly and has a curved vertical cross section. The hole 18*a* is held in communication with the hole 16*a*. The shaped workpiece $W_1$ from the forward extrusion step shown in FIG. 1A is inserted in the hole 16*a*, and pressed downwardly toward the second lower die 18 by a second punch 20 having the same diameter as the hole 16*a*. The workpiece $W_1$ is forced partly into the hole 18*a*, and shaped into a workpiece $W_2$. The shaped workpiece $W_2$ will then be processed in a next step.

Figure 1C:
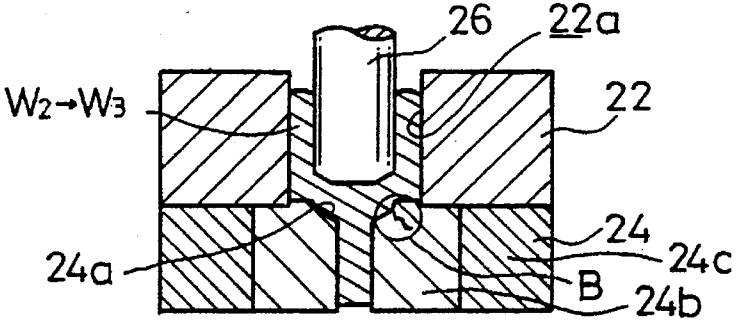
FIG. 1C is a cross-sectional view showing a third step of shaping the workpiece $W_2$ into a workpiece $W_3$ with the forming die in the cold-forging process.

As shown in FIG. 1C, the cold-forging process then uses a third upper die 22 and a third lower die 24, the third upper die 22 being stacked on the third lower die 24. The third upper die 22 has a larger-diameter through hole 22*a*, and the third lower die 24 has a smaller-diameter through hole 24*a* having an upper end which is spread upwardly and has a curved vertical cross section. The hole 24*a* is held in communication with the hole 22*a*. The shaped workpiece $W_2$ from the step shown in FIG. 1B is inserted in the hole 22*a*, and pressed downwardly toward the third lower die 24 by a third punch 26 having a diameter smaller than the diameter of the hole 22*a*. The workpiece $W_2$ is forced partly into the hole 24*a*, and shaped into a workpiece $W_3$. The workpiece $W_2$ has now been shaped in a backward extrusion step. The shaped workpiece $W_3$ will then be processed in a next step.

As shown in FIG. 1D, the workpiece $W_3$ is shaped into a workpiece $W_4$ for use as an inboard or outboard outer member of a constant-velocity joint.

It has been confirmed that when the workpieces $W_1$, $W_2$ are pressed by the respective punches 14, 26 in the forward extrusion step shown in FIG. 1A and the backward extrusion step shown in FIG. 1C, cracks A, B are developed in the dies 12, 24, respectively, by the punches 14, 26. The cause of the crack B which is developed in the lower die 24 in the backward extrusion step shown in FIG. 1C will be predicted below.

When the punch 26 presses the workpiece $W_2$, stresses are produced between the upper and lower dies 22, 24. The produced stresses include a tensile stress and a compressive stress. It is considered that the compressive stress is largely responsible for the crack B developed in the lower die 24.

Figure 2:
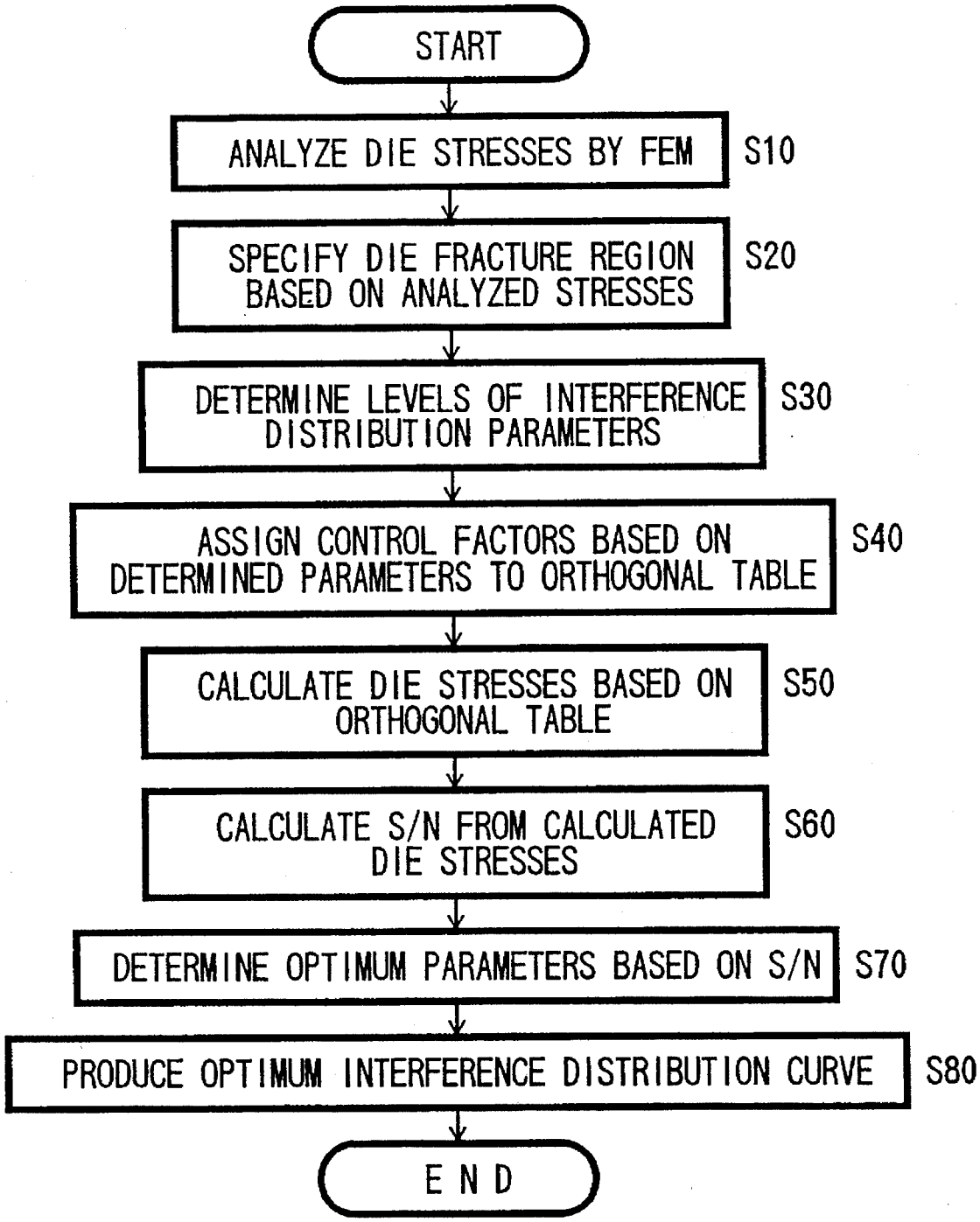
FIG. 2 is a flowchart of a method of manufacturing a forming die according to the present invention.

The formation of an inner circumferential shape of a reinforcing ring for a forming die will be described below with reference to FIG. 2. In FIG. 1C, the lower die 24 comprises a die member 24*b* and a reinforcing ring 24*c* pressed around the die member 24*b*. The die member 24*b* has a cylindrical outer circumferential surface.

Using the finite element method (FEM), the die member 24*b* is divided into a plurality of elements, and plastic strains and tensile stresses applied to those elements are calculated in a step S10. The calculated tensile stresses as applied to the die member 24*b* are indicated by arrows C in FIG. 3.

Figure 3:
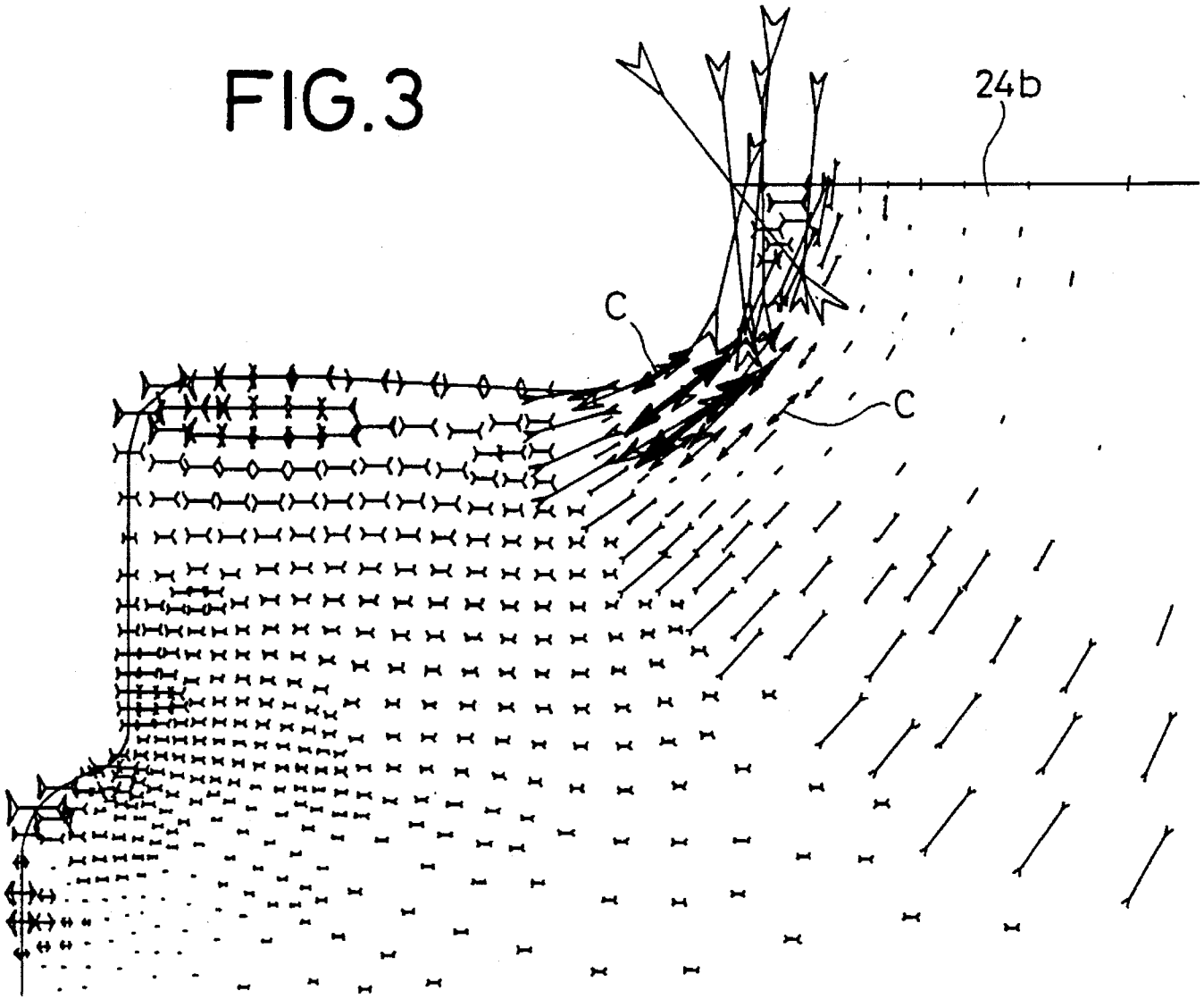
FIG. 3 is a view showing a broken region of the forming die.

Fracture regions where the tensile stresses shown in FIG. 3 exceed the yield stresses of the material of the die member 24*b* are specified in a step S20. The crack B is developed in those fracture regions.

Figure 4A:
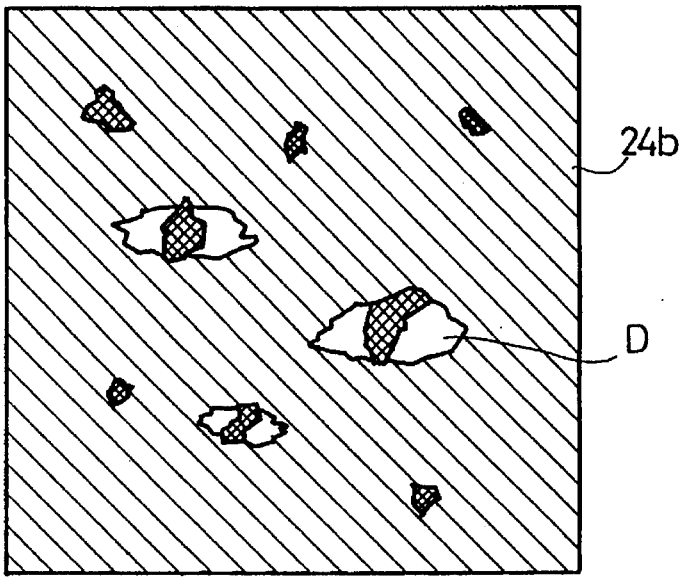
FIG. 4A is a cross-sectional view showing crevices developed in a member of the forming die.
Figure 4B:
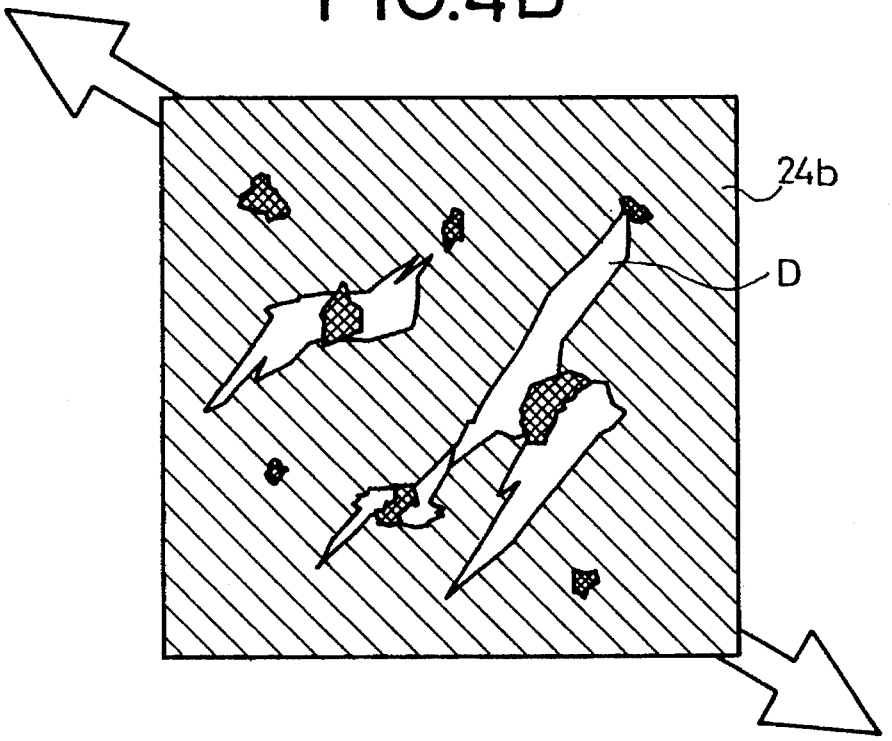
FIG. 4B is a cross-sectional view showing the manner in which the crevices shown in FIG. 4A are enlarged under tensile stresses.

The crack B is developed in the die member 24*b* because minute crevices D have been produced in the die member 24*b* due to plastic strains and the minute crevices D are enlarged by tensile stresses. More specifically, as shown in FIG. 4A, minute crevices D have been produced in the die member 24*b* due to plastic strains. When tensile stresses C are produced in the die member 24*b* as shown in FIG. 3, the die member 24*b* is pulled in the directions indicated by the arrows in FIG. 4B. As a result, the minute crevices D are enlarged, and when the applied tensile stresses C exceed the yield stresses of the material of the die member 24*b*, a crack is developed in the die member 24*b* in a direction perpendicular to the directions of the tensile stresses.

If a constant-velocity joint is formed using the upper and lower dies 22, 24, then cracks will be developed in die regions corresponding to a cup and a flange, respectively, of the constant-velocity joint.

To prevent cracks from being developed in those die regions, i.e., fracture regions, compressive stresses are applied in advance to counteract the tensile stresses in the fracture regions. This is because the applied compressive stresses are effective to eliminate plastic strains for thereby preventing crevices from being produced, or to prevent any minute crevices which have already been produced by plastic strains from being enlarged.

Based on the above analysis, the reinforcing ring 24*c* is fitted over the die member 24*b*, and an interference therebetween is established based on the outer circumferential configuration of the reinforcing ring 24*c* to apply compressive stresses to the die member 24*b* to counteract tensile stresses in fraction regions. For generating maximum compressive stresses, it is necessary to appropriately distribute a pressing interference between the reinforcing ring 24*c* and the die member 24*b*, i.e., to determine an appropriate outer circumferential configuration of the reinforcing ring 24*c*.

Determination of an outer circumferential configuration of the reinforcing ring 24*c* will be described below.

Figure 5:
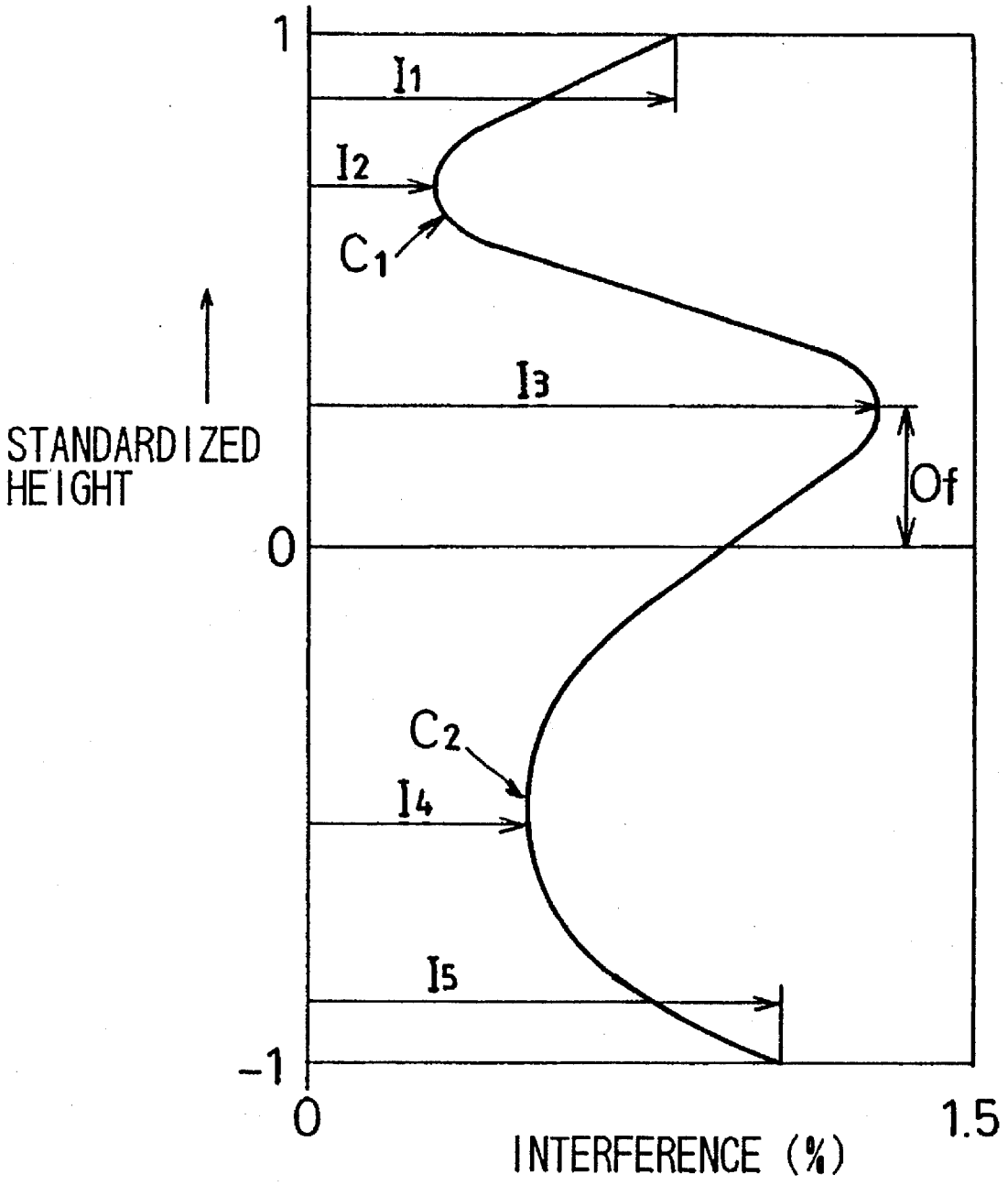
FIG. 5 is a diagram showing an interference distribution curve used in the method according to the present invention.

After the fracture regions are specified in the step S20, the levels of interference distribution parameters are determined based on the forging experience in a step S30. FIG. 5 shows a standardized interference distribution based on the forging experience. The graph shown in FIG. 5 has a horizontal axis representing an interference expressed as a percentage of the inside diameter of the reinforcing ring 24*c*, and a vertical axis representing the height of the reinforcing ring 24*c* which is standardized with respect to the intermediate position of the height.

In FIG. 5, interference parameters, i.e., control factors for controlling the interference, are determined as control factors $I_1$–$I_5$ based on radial lengths from the inner circumferential surface of the reinforcing ring 24*c* at respective predetermined height positions along the standardized height of the reinforcing ring 24*c*, a control factor $O_f$ based on an offset of the control factor $I_3$ along the height from the intermediate position of the height, a control factor $C_1$ based on the curvature of the interference distribution curve shown in FIG. 5 in its upper range along the height, and a control factor $C_c$ based on the curvature of the interference distribution curve shown in FIG. 5 in its lower range along the height. Each of these control factors is set to three parameter values or levels "1", "2", "3" which include a value determined based on the forging experience, a value reduced from the value by a certain %, and a value increased from the value by a certain %.

The control factors each set to the three parameter levels are assigned to an orthogonal square or table shown in FIG. 6 in a step S40. After the step S40, an inner circumferential configuration of the reinforcing ring 24*c* is generated based on the control factors in each row of the orthogonal table shown in FIG. 6, i.e., a combination of eight control factors in each row in the orthogonal table, and stresses produced in the die member 24*b* by the reinforcing ring 24*c* with the generated inner circumferential configuration are calculated according to the finite element method in a step S50. In the calculation of stresses, variations of the manufacturing conditions are taken into consideration which include at least the distance by which the punch is pressed, the die hardness, and the shape of the formed object.

The stresses produced in the die member 24*b* by the reinforcing ring 24*c* are calculated with respect to worst and best sets of variations of the manufacturing conditions. The calculated stresses are indicated in columns $N_1$, $N_2$ entitled "STRESSES" in FIG. 6. The column $N_1$ shows the calculated stresses in the worst set of variations of the manufacturing conditions, and the column $N_2$ shows the calculated stresses in the best set of variations of the manufacturing conditions.

The stresses are calculated with respect to the combinations of control factors in the respective rows of the orthogonal table shown in FIG. 6. In FIG. 6, some of the calculated stresses are indicated by $\alpha_1, \alpha_2, \ldots \beta_1, \beta_2, \ldots$ The step S50 is followed by a step S60 in which S/N ratios are calculated based on the variances of the stresses in the worst and best sets which are determined from the calculated stresses. In FIG. 6, some of the S/N ratios are indicated by $\gamma_1, \gamma_2, \ldots$ The S/N ratios are measures for optimally designing forming dies.

The sum of S/N ratios with respect to each of the levels of the control factors $I_1, I_2, I_3, I_4, I_5, O_f, C_1, C_2$ is calculated. One example of the calculation of the sum of S/N will be described below with respect to the control factor $I_2$. The S/N ratios with respect to the column of the level "1" of the control factor $I_2$ are summed, the S/N ratios with respect to the column of the level "2" of the control factor $I_2$ are summed, and the S/N ratios with respect to the column of the level "3" of the control factor $I_2$ are summed. The level which exhibits the maximum S/N ratio among the summed S/N ratios at the respective levels is selected with respect to the control factor $I_2$.

Similarly, the levels with respect to the other control factors $I_1, I_3, I_4, I_5, O_f, C_1, C_2$, are calculated, respectively and the levels with respect to each of the other control factors are selected. The selected levels of the control factors $I_1, I_2, I_3, I_4, I_5, O_f, C_1, C_2$, are now determined as optimum parameters in a step S70. Thereafter, an optimum interference distribution curve as shown in FIG. 5 is determined based on the determined optimum parameters in a step S80. The optimum interference distribution curve is made smooth by interpolating values between the determined levels of the control factors $I_1, I_2, I_3, I_4, I_5, O_f, C_1, C_2$.

Figure 7A:
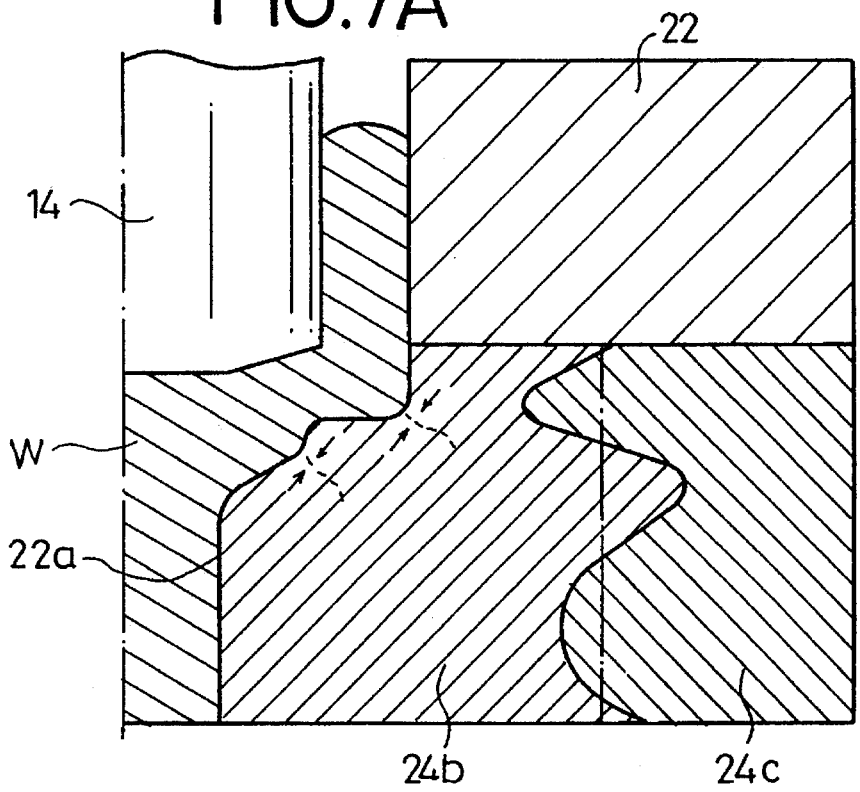
FIG. 7A is a cross-sectional view of a reinforcing ring having an inner circumferential surface shaped by the method according to the present invention and a die member pressed in the reinforcing ring.

The inner circumferential surface of the reinforcing ring **24*c* is machined to a configuration based on the optimum interference distribution curve determined in the step S80. The die member 24*b* is then press-fitted into the reinforcing ring 24*c* as shown in FIG. 7A. Since the inner circumferential surface of the reinforcing ring 24*c* has been shaped to the optimum interference distribution curve determined in the step S80, compressive stresses are produced to counteract tensile stresses in fracture regions in the die member 24*b* as indicated by the arrows in FIG. 7A under forces that are applied from the reinforcing ring 24*c* to the die member 24*b***. Accordingly, cracks are prevented from being developed in those fracture regions.

Figure 7B:
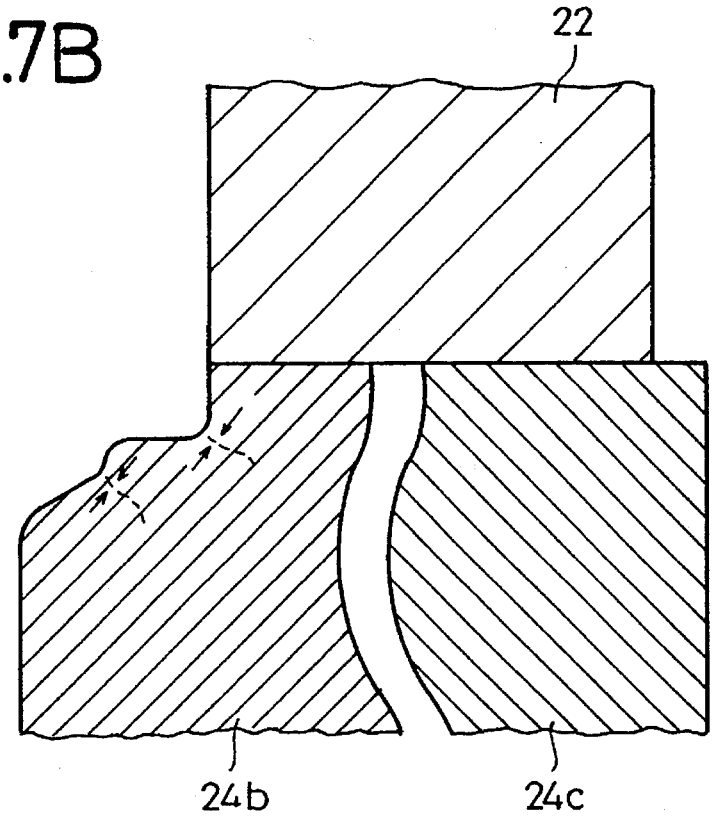
FIG. 7B is an enlarged fragmentary cross-sectional view of a portion of the die member and the reinforcing ring shown in FIG. 7A.

FIG. 7B shows a portion of the die member **24*b* and the reinforcing ring 24*c* at an enlarged scale. In FIG. 7B, the die member 24*b* and the reinforcing ring 24*c* are shown as spaced from each other, and the die member 24*b* is shown as being deformed under forces applied from the reinforcing ring 24*c*. FIG. 7B clearly illustrates the manner in which compressive stresses are produced in the die member 24*b***.

In the illustrated embodiment, the inner circumferential surface of the reinforcing ring **24*c* is machined to produce compressive stresses in the die member 24*b*. However, the outer circumferential surface of the die member 24*b* may be machined and cooperate with a cylindrical inner circumferential surface of the reinforcing ring 24*c* in producing compressive stresses in the die member 24*b***. In this modification, an optimum interference distribution curve may be determined in the same manner as described above.

With the present invention, as described above, the inner circumferential surface of a reinforcing ring or the outer circumferential surface of a die member is machined to a shape based on an optimum interference distribution curve which produces compressive stresses in the die member to counteract tensile stresses that are produced in the die member when a workpiece to be formed is inserted into the die member. The die member and the reinforcing ring cooperate with each other in either preventing cracks which would otherwise be caused in the die member by tensile stresses or reducing or substantially eliminating minute crevices generated in the die member due to plastic strains. Since the die member is thus prevented from cracking and hence being broken, the service life of the die member is increased.

The optimum interference distribution curve which is used to prevent the die member from cracking can be obtained through the theoretical process, but not on trial-and-error efforts, and can also be produced while taking into consideration variations of manufacturing conditions. Therefore, the method according to the present invention is highly practical in use.

Although a certain preferred embodiment of the present invention has been shown and described in detail, it should be understood that various changes and modifications may be made therein without departing from the scope of the appended claims. Such variations are not to be regarded as a departure from the spirit and scope of the invention, and all such modifications as would be obvious to one skilled in the art are intended to be included within the scope of the following claims.

What is claimed is:

1. A method of manufacturing a forming die composed of a die member and a reinforcing ring for applying compressive forces radially inwardly to the die member, comprising the steps of:

(a) simulating tensile stresses applied to elements divided from the die member;

(b) specifying a fracture region of the die member based on the simulated tensile stresses;

(c) determining an inner circumferential configuration of the reinforcing ring to cooperate with the die member in producing compressive stresses in the die member to counteract tensile stresses in said fracture region;

(d) forming the reinforcing ring with said inner circumferential configuration; and (e) fitting said reinforcing ring with said inner circumferential configuration over said die member.

2. The method according to claim 1, wherein said step (c) comprises the steps of:

generating an orthogonal table of factors including values which represent interferences at a plurality of different heights from a first reference at a bottom of an unformed reinforcing ring, as lengths from a second reference at a cylindrical inner circumferential surface of the unformed reinforcing ring, and information values based on variations of conditions in which a workpiece is fitted in a cavity in the die member;

determining optimum values of the lengths based on said orthogonal table to generate an interference distribution curve; and determining the inner circumferential configuration of the reinforcing ring based on said interference distribution curve.

3. The method according to claim 2, wherein said variations include at least a distance by which a punch is pressed into said cavity, a hardness of the die member, and a shape of an object formed by the forming die.

4. A method of manufacturing a forming die composed of a die member and a reinforcing ring for applying compressive forces radially inwardly to the die member, comprising the steps of:

(a) simulating tensile stresses applied to elements divided from the die member;

(b) specifying a fracture region of the die member based on the simulated tensile stresses;

(c) determining an outer circumferential configuration of the die member to cooperate with the reinforcing ring in producing compressive stresses in the die member to counteract tensile stresses in said fracture region;

(d) forming the die member with said outer circumferential configuration; and (e) fitting said reinforcing ring over said die member with said outer circumferential configuration.

5. The method according to claim 4, wherein said step (c) comprises the steps of:

generating an orthogonal table of factors including values which represent interferences at a plurality of different heights from a first reference at a bottom of an unformed die member, as lengths from a second reference at a cylindrical outer circumferential surface of the unformed die member, and information values based on variations of conditions in which a workpiece is fitted in a cavity in the die member;

determining optimum values of the lengths based on said orthogonal table to generate an interference distribution curve; and determining the outer circumferential configuration of the die member based on said interference distribution curve.

6. The method according to claim 5, wherein said variations include at least a distance by which a punch is pressed into said cavity, a hardness of the die member, and a shape of an object formed by the forming die.

* * * * *